US010713905B2

(12) United States Patent
Farris et al.

(10) Patent No.: US 10,713,905 B2
(45) Date of Patent: Jul. 14, 2020

(54) DEVICE FOR SIGNALLING AUDIBLE ALARMS AND THE LIKE

(71) Applicant: INTENDIME SRIS, Sestu (CA) (IT)

(72) Inventors: Alessandra Farris, Sestu (IT); Giorgia Ambu, Sestu (IT); Antonio Pinese, Sestu (IT); Leonardo Buffetti, Sestu (IT); Riccardo Arciulo, Sestu (IT)

(73) Assignee: INTENDIME S.R.L., Cagliari (CA) (IT)

( * ) Notice: Subject to any disclaimer, the term of this patent is extended or adjusted under 35 U.S.C. 154(b) by 0 days.

(21) Appl. No.: 16/325,019

(22) PCT Filed: Aug. 8, 2017

(86) PCT No.: PCT/IB2017/054841
§ 371 (c)(1),
(2) Date: Feb. 12, 2019

(87) PCT Pub. No.: WO2018/029603
PCT Pub. Date: Feb. 15, 2018

(65) Prior Publication Data

US 2019/0197839 A1 Jun. 27, 2019

(30) Foreign Application Priority Data

Aug. 12, 2016 (IT) ..... 102016000085079

(51) Int. Cl.
*G08B 1/08* (2006.01)
*H04R 3/00* (2006.01)

(52) U.S. Cl.
CPC ..... *G08B 1/08* (2013.01); *H04R 3/00* (2013.01); *H04R 2201/023* (2013.01); *H04R 2410/00* (2013.01); *H04R 2499/11* (2013.01)

(58) Field of Classification Search
None
See application file for complete search history.

(56) References Cited

U.S. PATENT DOCUMENTS 2,391,882 A * 1/1946 Conn ..... G08B 1/08 361/182
4,509,151 A * 4/1985 Anderson ..... G01V 1/38 367/118
9,305,442 B1 * 4/2016 Nesemeier ..... G08B 6/00
9,961,435 B1 * 5/2018 Goyal ..... H04R 1/1083
(Continued)

*Primary Examiner* — Julie B Lieu
(74) *Attorney, Agent, or Firm* — Kristina Castellano; Castellano PLLC

(57) ABSTRACT

A device for signalling acoustic signals associated to a sound source to people having hearing problems. The device includes receiving and transmitting elements, which can be associated to a specific acoustic alarm, by an appropriate phase for recording and recognizing the sound and associating to an identifying code, near the emitting sound source. The device also includes a portable terminal, apt to receive and recognize the signals emitted by the receiving and transmitting elements. The device further includes software, installed on a portable processing device capable of connecting to the wireless connection of the portable terminal of providing an interface for programming the terminal, where each receiving and transmitting element is shaped like a plate acting as transducer for the mechanical vibration and includes a fastener to a surface.

12 Claims, 4 Drawing Sheets

(56) References Cited

U.S. PATENT DOCUMENTS

| | | | | |
|---|---|---|---|---|
| 2002/0026311 | A1* | 2/2002 | Okitsu | G10L 15/26 704/201 |
| 2006/0273895 | A1* | 12/2006 | Kollin | G08B 1/08 340/539.17 |
| 2011/0013075 | A1* | 1/2011 | Kim | H04N 5/602 348/370 |
| 2011/0102133 | A1* | 5/2011 | Shaffer | G08B 1/08 340/5.1 |
| 2012/0214515 | A1* | 8/2012 | Davis | G01S 5/22 455/456.3 |
| 2012/0243707 | A1* | 9/2012 | Bradley | G10L 19/00 381/98 |
| 2015/0168538 | A1* | 6/2015 | Bradley | G01S 5/18 367/127 |
| 2016/0117905 | A1* | 4/2016 | Powley | G08B 21/18 340/521 |

* cited by examiner

DEVICE FOR SIGNALLING AUDIBLE ALARMS AND THE LIKE

CROSS REFERENCE TO RELATED APPLICATION

This is a U.S. National Stage application of PCT/IB2017/054841 filed on Aug. 8, 2017, which claims priority to Italian Patent Application 102016000085079 filed on Aug. 12, 2016, the contents of both of which are hereby incorporated herein by reference.

The present invention relates to a device for signalling audible alarms, acoustic signals and any event thereto the reproduction of a sound is connected the source thereof can be identified. This signalling, which can be transduced into an alarm of visual type or into a vibration, is associated to an indication of the sound source, and then it allows people with hearing problems, in case even transitory problems as they are linked to working or leisure activities or to the use of earphones or the like, to be alerted of the event thereto such sound is associated.

By way of example and not with limitative purposes, the sounds which can be indicators are the ringing of a fixed telephone, a doorbell, the acoustic signal of a timer or of household appliance such as washing machine, oven, dishwashing machine, etc., the alarm of a smoke detector or of a burglar-resistant system, but it can easily be understood that the list is virtually infinite, and they are sounds which can be detected from the acoustic point of view and they are associated to a well precise sound source.

US patent applications No. 2006/273,895 A1 and No. 2016/117,905 A1 describe a receiving station which receives a radio signal from a plurality of detectors of audible alarms and which transmits a notice to a mobile device, in particular a mobile phone or to a television screen.

The object underlying the present invention is to provide a signalling device allowing to transfer any acoustic alarm which can be recognized and associated to a sound source to another device by means of emitting a not acoustic signal and the indication of said sound source, to allow people with hearing problems to recognize the acoustic alarm and to act consequently.

Such object is implemented by a device as defined in the enclosed claim 1, additional details are defined in the enclosed depending claims.

The main advantage of the device according to the present invention lies in the fact of allowing to recognize a plurality of acoustic signals, to each one thereof a receiving and transmitting element can be associated, at one single portable and wearable terminal, such as for example a bracelet, with substantially no capacity limits and with a programming moved to an additional device of common use.

The device then has a plurality of receiving and transmitting elements, each one thereof can be associated to a specific acoustic alarm, by means of a suitable phase for recording and recognizing the sound and associating to an identifying code, near the emission sound source thereof.

In details, the receiving and transmitting element comprises a sensor for receiving the acoustic alarm, conveniently of piezoelectric type, cooperating with a microprocessor, provided with at least a storage device, which implements the recognition of the acoustic alarm received by the acoustic sensor, by means of FFT analysis. Moreover, means for the radiofrequency transmission of a signal are provided, thereto the code identifying the receiving and transmitting element is associated.

The device for signalling the alarms then comprises a portable terminal, which is useful to receive and recognize the signals emitted by the receiving and transmitting elements; the terminal is constituted by a radiofrequency antenna, a processor associated to a storage device including a library of codes identifying receiving and transmitting elements, means for the wireless connection to a portable processing device, such as a smartphone and the like, for programming said processor and at last means for visual and/or vibration signalling.

At last, the device for signalling the alarms even comprises a software, installed on a portable processing device, such as smartphone and the like, capable of connecting to said means for the wireless connection and of providing an interface for programming said terminal.

Advantageously, each receiving and transmitting element is shaped like a plate, and it acts as transducer for the mechanical vibration, and moreover it comprises means for fastening to a surface which, conveniently, will be selected near the alarm sound source(s) to be monitored.

Furthermore, the plate could have the functionality of recognizing the proximity to the sound source, by means of a LED placed on the plate, which during the recording mode changes light intensity based upon the perceived intensity of the sound source, thus giving a visual response to the emission of the alarm which can be located near the alarm sound source(s) to be monitored.

The small-sized plates can be applied by means of an adhesive, a hook, or any other system, to a surface near a sound source, that is in approached position or directly applied on the source.

Hereinafter, for greater illustrating convenience, the term "plate" will be used to designate the receiving and transmitting element, with the obvious synthesis that such plate comprises a printed circuit board which implements the above-mentioned components (sensor, processor, storage device, transceiver antenna, battery) and needed to the operation thereof, plus possible other ones.

In the same way, the term "bracelet" will be used to designate the portable terminal which will be associated to said plurality of plates in the device according to the invention.

The present invention will be described hereinafter according to a preferred embodiment example, provided by way of example and not for limitative purposes with reference to the enclosed drawings wherein.

By referring to the figures, the herein described signalling device is constituted by a variable number of plates, for example five, and a bracelet which acts as receiver.

Each plate comprises a board with integrated circuits including a piezoelectric sensor for receiving an acoustic alarm, a microprocessor which is provided with at least a storage device and which is capable of implementing the recognition of the acoustic alarm by means of FFT analysis, and means, in particular a radiofrequency antenna, for transmitting a signal thereto a single identifying code of the plate is associated. The plate will further include means for fastening to a surface and a possible replaceable battery.

The bracelet, acting as terminal, on the contrary comprises a radiofrequency transceiver antenna, a processor associated to a storage device which includes a library of codes identifying the plates associated thereto, means for the wireless connection to a portable processing device, such as a smartphone and the like, for programming said processor, and means for the visual and/or vibration signalling. A preferably replaceable battery, a possibly waterproof casing and an opening and closing mechanism which allows a user to wear the bracelet will be further present.

Said storage device, apart from including the codes, also includes the names of the sound sources to be associated to the different plates, possibly available at a library integrated in the storage device or made available by means of an outer management software which will be explained hereinafter.

The wireless connection means can act by means of a standard protocol such as Bluetooth®. The visual and/or vibration signalling means can include a display, for example a possibly touchscreen display of OLED type, a vibration mechanism, systems for flashing and/or colour lighting which use LEDs, and a possible acoustic signalling device.

The display could show information related to the current time and date, the microprocessor could further play the role of clock and alarm clock.

The bracelet could further include a GPS antenna and means for detecting physiological data of the user wearing it, to monitor his/her healthy status (heart rate and the like).

It is further meant that different bracelets could be enabled to communicate therebetween and in case with a control unit, in case comprising telephone communication means, for example with a dedicated SIM, for possible emergency calls.

The plate is constructed so as to act as transceiver for the mechanical vibration which is associated to any device, system or object which produces audible alarms, acoustic alarms and the like and which is wanted to be recognized.

Figure 1:
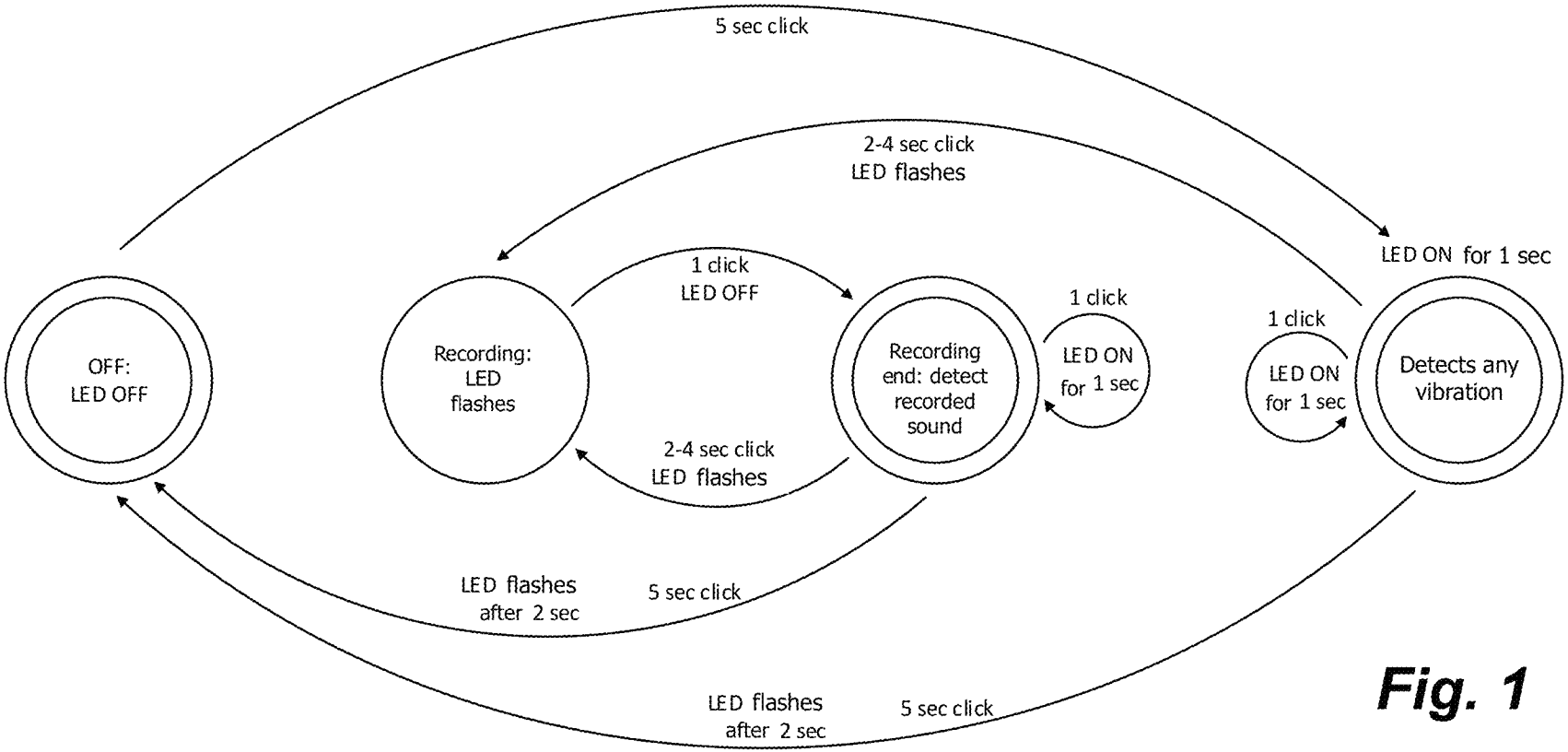
FIG. 1 illustrates a procedure for programming a device according to the present invention.
Figure 2:
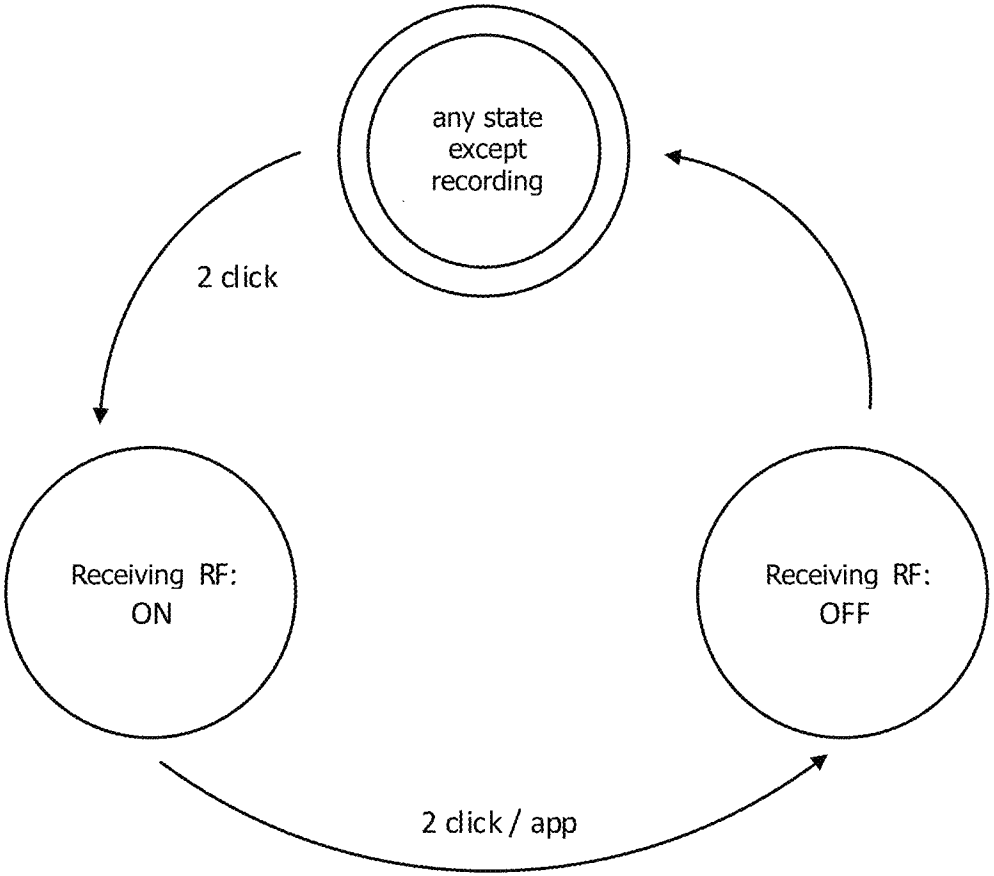
FIG. 2 illustrates a detail of the procedure for programming the device of FIG. 1.
Figure 3:
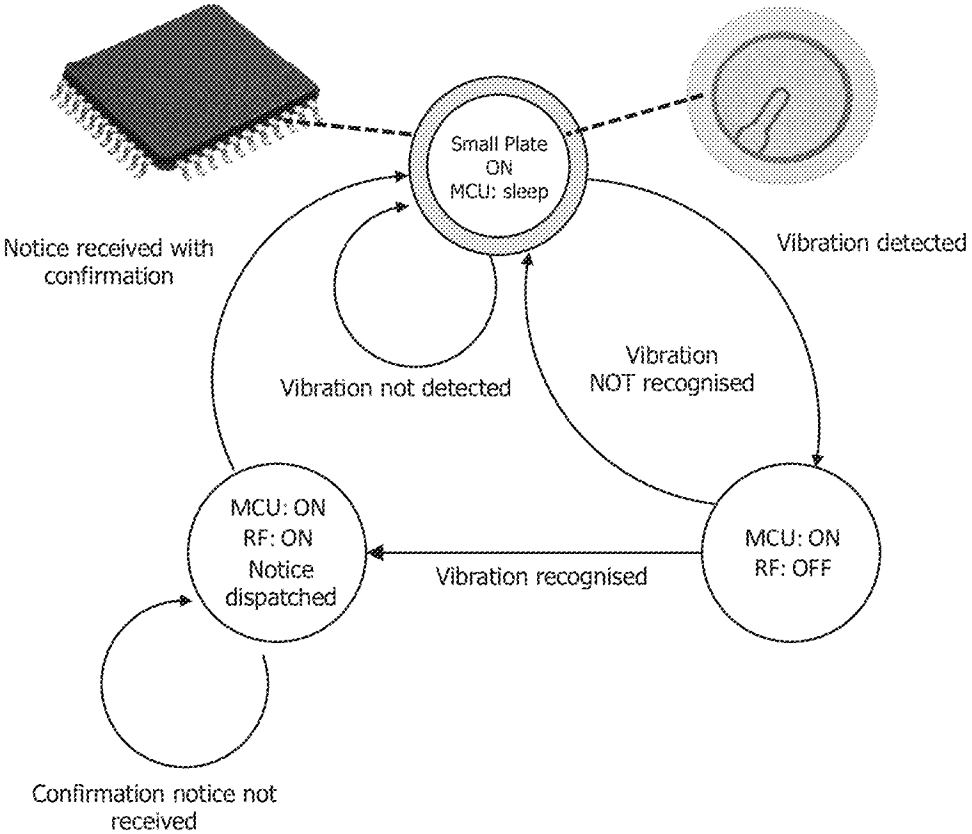
FIG. 3 illustrates an operating procedure of a component of a device according to the present invention.

The perception and the recognition of this mechanical vibration by the plate is distributed in several phases, which are enlisted in details hereinafter:

1. once the plate is applied on an object which rings, this is enabled, only for the first time, in a recording mode, so that it can keep a vibrational imprint to be compared and combined with the subsequent ones (FIG. 1);
2. in this recording mode, the object whereon the plate is applied physically is made to ring (FIG. 1);
3. once ended the recording phase by means of a control button, the imprint of the associated acoustic alarm has been recorded, and the plate is ready for the subsequent comparisons, unless a new recording phase is enabled again wherein, in case, the already existing imprint is cancelled or stored in a storage device to be used in future;
4. once enabled to the recognition phase, it is performed by means of comparison in two different phases (FIG. 3): the first phase is a threshold comparison, wherein if the sound is too weak at the level of signal width, it is discarded and the processor inside the plate does not activate, so as not to use up uselessly excess energy from the battery integrated in the plate; on the contrary if the threshold comparison is overcome, then the processor activates and the received vibration is compared with the imprint recorded by means of FFT analysis, wherein the frequencies included inside the signal, both sound, vibration or any signal which can be decomposed in harmonics, are decomposed, so as to go back to all harmonics necessary to implement a recognition similar to a digital fingerprint, then univocal.

Conveniently, both the phase for recording and the one for hearing the acoustic alarm take place by means of a piezoelectric sensor, so as not to be obliged to receive and "hear" any environmental sound and so as to discretize with greater precision only the sounds/vibrations thereto the plate is mechanically/physically associated.

Once the vibration has been recognized, the processor sends a radiofrequency notice which can be received by the bracelet (FIG. 4), for example at a frequency of 868 MHz, by means of the respective antennas. The message is obviously coded, that is it includes a univocal recognition key of the plate, to allow to have no interferences and it includes both the plate code and the battery use percentage, so as to communicate to the user how much the plate battery, therefrom it has just received the notice, is loaded.

Figure 4:
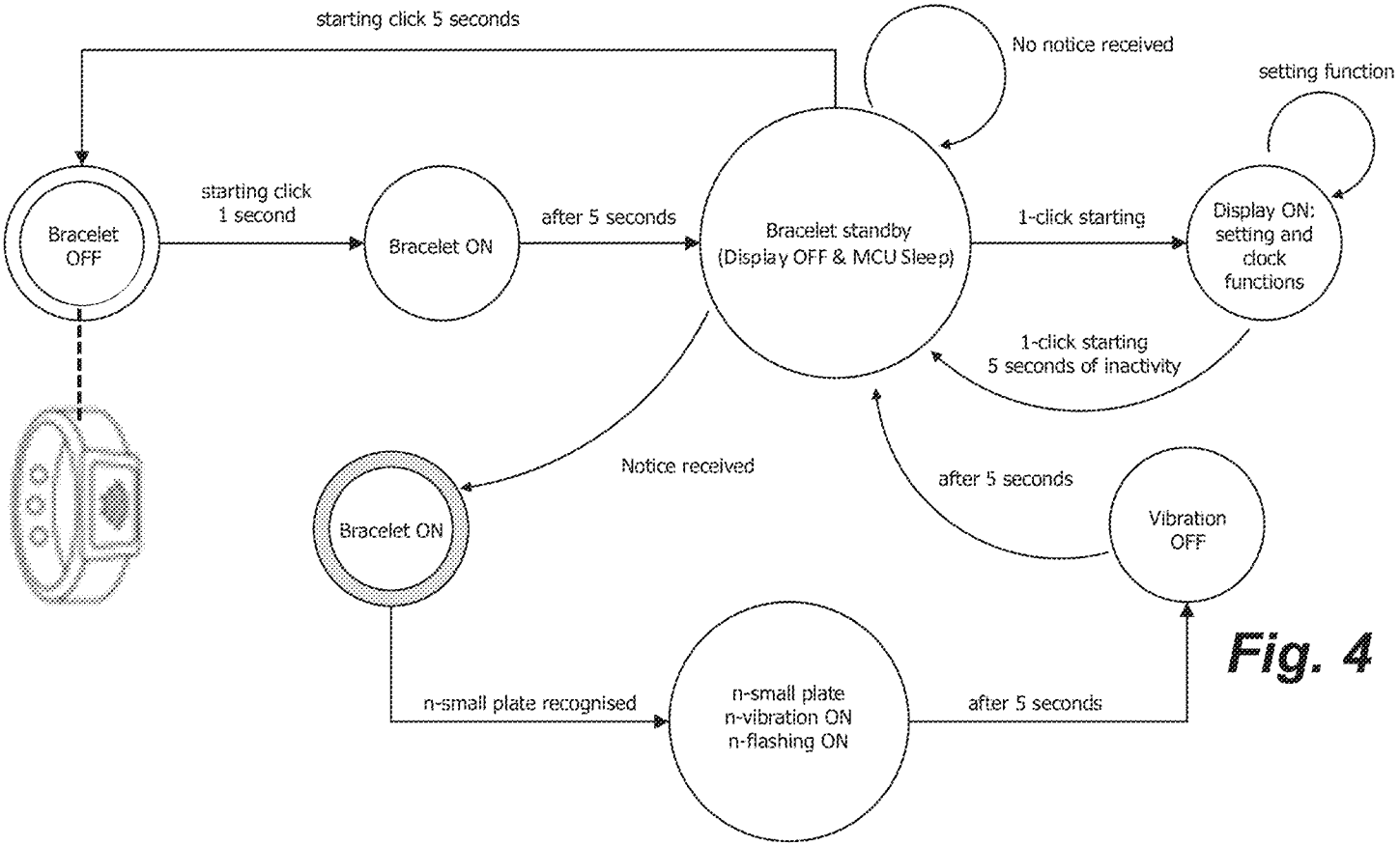
FIG. 4 illustrates an operating procedure of an additional component of a device according to the present invention.

Then, only for the first time, the bracelet receives a notice from the plate, including only the general recognition number. Since it knows that it has just made it to "ring", the bracelet recognizes exactly which plate it is and then one could proceed with assigning a name by using an outer software (FIG. 4).

This will be installed on a portable processing device, for example a smartphone, capable of connecting to the bracelet in wireless mode.

By means of such software and the graphical interface of the smartphone, it is possible to associate plate and bracelet, by assigning to the just detected plate a name among the pre-assigned ones, or one at will, which is recorded on the bracelet. Since then, the bracelet will not display anymore the general number for recognizing the plate, but the specific name assigned to it by the user.

The bracelet, apart from displaying the assigned name in the OLED display, flashes by means of one or more leds which will be installed and it vibrates.

Should the bracelets be more than one, they can call therebetween by means of a button, by despatching to the other one a notice by vibration and lighting. Then, it is provided that even the bracelets can be called by means of the software with a process analogous to the one used for the plates. This bracelet-bracelet communication can take place always by radiofrequency, without using the smartphone.

On the bracelet there is a "helping" bracelet which activates a robotised emergency call and/o a SMS or other notice addressed to one or more relatives or other people responsible for the user, the emergency contact thereof has been pre-set by software.

The bracelet operates even as ordinary clock and alarm clock, thus allowing the person with hearing problems to be waken up by vibration of the same, the hours being set both by the bracelet and the software.

The plate will also have the possibility of recognizing the proximity to the sound source, that is of detecting precisely the place of origin of the sound, thus allowing the user to position it better on the object which is wanted to be perceived. This will take place with one single LED placed on the plate, which during the recording mode could signal, by changing light intensity, the proximity to the sound source.

By taking as example the bell, this functionality will allow to fasten the plate exactly above the bell beeper and not simply on a not precise point of the body, consequently by increasing the precision thereof.

One will also be capable to enable or disenable, from the bracelet, the notice reception to save battery or for convenience (for example when one goes out of the house). As to the possibility of recognizing the vibration by the plate, some events are to be added which can take place inside the receiving environment, therefor a different programming of the plate is required. One thereof relates to the fact of offering the user the possibility to have the plate already active for pre-set sounds, such as in case of a fire alarm. In fact, since the alarm at issue cannot easily be activated by the user for the procedure of recording the sound and that inevitably several difficulties such as a situation of deep unease would be produced, it is possible to obviate the problem by providing him/her the possibility to be informed should an intense sound occur near the plate.

On the contrary, as far as the sounds which can be reproduced easily are concerned, one refers directly to the usual recording.

There is further the possibility of programming two additional specific functionalities for "Prolonged Sound Notice" and "Terminated Sound Notice". These two modes require the use of software, which allows to program directly the plate, since a modification at the level of the detection management is necessary involving then a better conservation of energy and interrupts inherent the plate processor. In this case, the plate will have to be activated in advance to be able to receive this type of commands, since usually it is not activated (energy saving as the RF reception is off), for example by simply double-clicking on the button (there is the feedback by the led).

A specific embodiment example of the plate comprises:

- a Cortex® processor by Silicon Lab, incorporating a RF 868 MHz transceiver inside thereof;
- a piezoelectric sensor;
- a circuit for amplifying the signal of the piezoelectric signal;
- a Fuelgauge, better known as current sensor, to measure the battery consumption;
- a button;
- a LED;
- an antenna obtained from an integrated track;
- a miniUSB port for re-charging the battery and for re-programming the firmware;
- a housing for a CR2032 battery.

On the contrary, a specific embodiment example of bracelet terminal comprises:

- a Cortex® processor of Silicon Lab, incorporating inside thereof a RF 868 transceiver;
- a Bluetooth module;
- a square or round OLED display module;
- an integrated circuit acting as Power Manager, managing turning-on, standby and battery re-charging;
- a Fuelgauge integrated circuit or current sensor, for measuring the battery consumption;
- four LEDs: one for signalling turning-on and discharge and three for signalling notice received or a smaller number of LEDs but of GB type, with different colours associated to different functions;
- three buttons: one for turning-on and two for the options (one or more thereof, pressed for a long time or contemporarily, will act as emergency call);
- a miniUSB port for re-charging the battery and for re-programming the firmware;
- a 3.7V 300 mAh lithium polymer battery; and
- a vibration engine.

The bracelet, as preferably it is completely water-repellent (it has to allow the user to be able to wear it for example in the shower or at the sea) requires an induction recharging or a recharging system with controlled contacts.

On this matter, to the bracelet hardware portion a small base is to be added which only acts as connection between the feeder (or USB of a PC) and the bracelet, thus allowing to feed the bracelet and re-charge it. A 220V to 5V feeder could be purchased in case by third parties. The battery could be taken off the bracelet body so as to allow to be replaced with a second already charged battery. In this way, the user can constantly wear the bracelet at the wrist and be always connected to the system. The so separate battery could be re-charged by simply placing it on the recharging base.

Both the plate and the bracelet can be equipped even with a three-axis sensor of accelerometer type. A plate of this type allows to advise the user on the receiving terminal whenever a shifting or an oscillation in the space occurs, or in case even to detect when an earthquake occurs.

A bracelet equipped with accelerometer, instead, integrates the function of activating the display upon lifting the wrist, to allow reading the information without having to press the button.

As far as the software is concerned, it will have the following functionalities:

- to allow the user to name again the plates, that is to allow the bracelet to associate a new name to the code identifying the plate, to be displayed on the display—the user could have available a series of pre-set names (bell, intercom, telephone, alarm clock) and the possibility of inserting any name not on the list;
- to allow the user to select, for each plate and independently from the other ones, the type of lighting and vibration which he/she wants to associate to each specific notice, by selecting it among the pre-set ones. Each mode will have lighting and vibration which are different from each other in intermittence, duration and execution;
- in case of danger, to allow the user to notify someone close to him/her directly from the bracelet by pressing a button (the command starts from the bracelet, but the software enables it);
- to despatch on the bracelet notices of incoming calls, SMS or notices from a Social Network or other messaging services;
- to give the user the possibility of configuring the plate for additional functionalities capable of extending the use of the whole system. One refers in particular to the functionality of "prolonged sound notice" thanks thereto it will be possible to set the time limit therefor the user wants to be advised when the sound is prolonged or terminated, in this specific case by means of the function "terminated sound notice" when the sound has ceased;
- to be the means to be able to verify the range of the plate (previously activated for RF reception with double click): in this case the software will show graphically the level of signal which is received as one moves away from the plate, in this way, the user will be calmer as he/she awares that he/she can receive a notice related to the whole house or areas of his/her specific interest, very important in case la plate is applied on the car parked outside the house, to know if one is victim of theft or accident. It will be further possible to turn off RF by means of the software or alternatively it will turn off automatically by inactivity;
- during the recording phase, to allow the user to keep under control the vibration/sound intensity which the plate is currently perceiving, by means of the software which will represent it graphically, even showing if the level is quite good for the correct detection. Consequently, the user could position it in optimum way on the object which he/she wishes to perceive;

to allow to select at will which notices are to be received, by customizing not only the warning modes thereof, but even the time slots wherein one wishes to keep active or to deactivate the notice system;

to have the possibility of setting the bracelet for advising the sounds detected by the plate which occur in hours outside the set time: then it will be possible to set, for example, that beyond a set time, the single or the different plates advise the user should they detect an "anomalous" activity—such option demonstrates to be useful in case the plates are used as alarm system by applying them on doors or windows, on the car, etc., in this way the user does not receive the notice if he/she himself/herself carries out those actions, but he/she receives the notice if this happens when it is outside the house or he/she is sleeping (timer which can always be set at user's discretion).

This mode does not influence on the programming which was given to the plate: in fact, if for example the plate was set to advise when a sound prolongs for half an hour, when this detects a sound outside the normal operation time, it however despatches the notice to the bracelet.

By referring to what described above, it is to be meant that the radio communication between plates and bracelet could also take place by means of a standard Bluetooth® with the possibility of using as terminals even already existing devices, available on the market, although programmable by the user by means of a suitable App.

The central unit mentioned above can be even actuated by communicating Hub, so as to increase the range and thus allowing a Wifi-3G-Ethernet connection or other ones, capable of opening the way to another series of use options, including the possibility of receiving the signalling even away from home.

Moreover, plates with an enlarged antenna for big spaces could be provided, places such as schools for deaf people or offices of various nature, wherein obviously due to the spatial extension, the distances to be covered result to be much wider.

The same plates could have an integrated SIM: this type of plate would allow to receive SMS, calls or warning of various kind directly via software, which in turn will be connected to the server and then to one's online account wherein all advices despatched by the plates will group. In this way it will be possible to have full control of one's house via web, then the advice would not be limited to the App, but it would extend to all devices which have access to a browser.

Parallelly to the implementation of the plates with SIM, one could do the same thing with the whole system, by providing it with bracelet with SIM and RF plates connected thereto. In this way, this could be configured remotely by means of the bracelet: for example, should a user find difficulties in the system configuration, he/she could request the technical assistance remotely and make use of the professionality of an expert which configures it for him. By making so, the system could be controlled by any device connected to the network and the configuration possibilities would extend easily by going well beyond the App (advise by SMS, emergency advice by SOS call).

The system can be provided with RF-USB-RF converters, for a connection of the plates directly to a smartphone telephone or to a PC via USB port. This would allow the communication of the plates with devices different from the bracelet.

The software of plate and bracelet could have the possibility of being updated by means of a connection to a PC even by means of miniUSB port therewith they could be provided, or by means of another connection type.

At last, the plate could be of ultra-thin type, which does not require battery, but which is self-fed by the vibration detected by the piezoelectric sensor.

It is to be meant that the bracelet terminal could be of advanced type, for example a smartwatch, already having the functionalities described above and capable to connect with an additional portable processing device like a smartphone. Moreover, the functionalities of the portable processing device like a smartphone described above could be integrated in the bracelet terminal like a smartwatch or the like.

To the above-described device a person skilled in the art, with the purpose of satisfying additional and contingent needs, could introduce several additional modifications and variants, all however comprised within the protective scope of the present invention, as defined by the enclosed claims.

The invention claimed is:

1. A device for signalling audible alarms or other specific acoustic signals associated to a respective sound source, which comprises:

a plurality of receiving and transmitting elements, each one thereof can be associated to a specific acoustic alarm, by an appropriate phase for recording and recognizing the sound and associating to an identifying code, near the emitting sound source thereof, each receiving and transmitting element comprising:

a piezoelectric sensor for receiving the acoustic alarm;

a microprocessor provided with at least a storage device, implementing the recognition of the acoustic alarm by FFT analysis; and means for the radiofrequency transmission of a signal thereto the code identifying the receiving and transmitting element is associated, a portable terminal, apt to receive and recognize the signals emitted by the receiving and transmitting elements, having:

a radiofrequency antenna:

a processor associated to a storage device including a library of codes identifying receiving and transmitting elements, means for the wireless connection to a portable processing device, for programming said processor; and means for the visual and/or vibration signalling, a software, installed on a portable processing device, capable of connecting to said means for the wireless connection and to provide an interface for programming said terminal, wherein each receiving and transmitting element is shaped like a plate acting as transducer for the mechanical vibration associated to the above-mentioned acoustic alarm, and it comprises means for fastening to a surface.

2. The device according to claim 1, wherein the plate has the functionalities of recognizing the proximity to the sound source and to show such proximity, and to this regard it has a LED placed on the plate, which during the recording mode changes light intensity based upon the perceived intensity of the sound source.

3. The device according to claim 1, wherein the terminal is shaped substantially like a bracelet and has a waterproof casing.

4. The device according to claim 1, wherein the means for the wireless connection act by a Bluetooth® protocol.

5. The device according to claim 1, wherein the means for the visual and/or vibration signalling include a possible touchscreen display, a vibration mechanism and systems of flashing and/or colour lighting which use a plurality of LEDs.

6. The device according to claim 1, wherein a central unit is provided, connected to one or more terminals, comprising telephone communication means for emergency calls, a "helping" button being provided on the terminal, which activates a robotised emergency call and/or a SMS.

7. The device according to claim 1, wherein the sound recording and recognition phase comprises a threshold comparison, wherein if the sound is too weak at the level of the signal width, this is discarded, and said FFT analysis, wherein the frequencies included inside the signal are decomposed.

8. The device according to claim 1, wherein the receiving and transmitting element comprises an already stored acoustic alarm.

9. The device according to claim 1, which comprises a RF-USB-RF converter.

10. The device according to claim 1, wherein the receiving and transmitting element or the terminal are equipped with a three-axis accelerometer.

11. The device according to claim 3, wherein the receiving and transmitting element or the terminal are equipped with a three-axis accelerometer.

12. The device according to claim 1, wherein the portable processing device comprises a smartphone.

* * * * *